United States Patent [19]

Zelinski

[11] 4,170,294

[45] Oct. 9, 1979

[54] SHIPPING AND DISPLAY TRAY AND PACKAGE

[76] Inventor: Robert J. Zelinski, 5364 Dakota Dr., Richfield, Ohio 44286

[21] Appl. No.: 894,555

[22] Filed: Apr. 10, 1978

[51] Int. Cl.[2] ..... B65D 65/16; B65D 85/62

[52] U.S. Cl. ..... 206/45.33; 206/432; 206/497; 206/503; 206/806; 206/493

[58] Field of Search ..... 206/497, 432, 45.34, 206/335, 45.33, 806, 493; 229/2.5; 220/8

[56] References Cited

U.S. PATENT DOCUMENTS

| | | | |
|---|---|---|---|
| 3,369,659 | 2/1968 | Ettlinger, Jr. | 206/503 |
| 3,650,395 | 3/1972 | Hobbs | 229/2.5 |
| 3,675,767 | 7/1972 | Taylor | 206/432 |
| 3,710,930 | 1/1973 | Owdom | 220/8 |

*Primary Examiner*—William T. Dixson, Jr.
*Attorney, Agent, or Firm*—Pearne, Gordon, Sessions, McCoy & Granger

[57] ABSTRACT

A generally flat based tray is used for both shipping and display of internal combustion engine oil filters. The typical oil filter has female threads in one end of a cylindrical base and utilizes an annular gasket on that cylindrical base to make a seal with the engine. The generally flat base of the tray includes frusto-conical male projections which are laterally deformable so that the threads of the oil filter are screwed onto these projections and deform them to establish formed threads on the projections which secure the oil filter to the tray and also trap the annular gasket between the oil filter and the tray base. The entire package may be shrink wrapped with a transparent material to aid in securing the filters to the tray especially during the rough handling of shipping. The trays may be utilized as a display device by being laid flat on a horizontal surface or may be hung by keyhole slots to be displayed on a vertical surface. The empty trays may be stacked with the projections interfitting to permit this stacking. The loaded trays may also be stacked, the shrink-wrap material being sufficiently resilient to permit an interfitting engagement between upper and lower packages. The foregoing abstract is merely a resume of one general application, is not a complete discussion of all principles of operation or applications, and is not to be construed as a limitation on the scope of the claimed subject matter.

16 Claims, 4 Drawing Figures

SHIPPING AND DISPLAY TRAY AND PACKAGE

BACKGROUND OF THE INVENTION

Shipping and display packages have previously been attempted including one which has a flat base with four upstanding legs defining a cylindrical recess into which the threads of a plug type electric fuse may be pushed. The frictional engagement between these legs and the fuse retains the plug fuse in place.

A hair roller holder has been proposed which has a stepped cylindrical outer surface. These three steps merely support three different sizes of hollow cylindrical hair rollers. This unit is not intended as a shipping unit but merely as a convenient stand to hold the hair rollers for the user.

Another prior art construction was one wherein glass jars such as baby food jars could be screwed upwardly into a female threaded support on the underside of a shelf. The jars could then be used to store items for the homeowner such as screws and nails.

Another prior art construction was a storage tray for socket wrenches with an upstanding lug which is square in cross section to receive the square drive opening of the socket wrench.

Another prior art construction of a shipping package was to use an end cap at each end of a hollow spool of ribbon with a molded upstanding lug on each end cap which frictionally engaged the hollow end of the spool.

The prior art constructions showed the support of generally lightweight items and generally used frictional engagement between the item and some support structure to temporarily hold the item in place. Such frictional engagement may be satisfactory for lightweight items or for items displayed on a shelf, yet they are not satisfactory for withstanding the rough handling during shipping. Such items would become dislodged from the support. Such dislodgement would not only tend to cause damage to the items as they bumped into each other, but also they may become lost during shipment.

SUMMARY OF THE INVENTION

The problem to be solved therefore is how to establish a shipping and display tray and package, wherein relatively heavy and bulky items may be satisfactorily secured to a support base, and also to trap and hold a potentially loose part, yet the entire item being readily removable by hand from the support base. This problem is solved by a shipping and display tray for use in connection with a plurality of internal combustion engine oil filters having female threads and annular gaskets comprising, in combination, a generally flat base, a plurality of male projections protruding upwardly from and attached to said base, said projections being of a semi-rigid material deformable in a direction parallel to said base, and said projections being engageable by female threads on an oil filter to trap the annular gasket of the oil filter between said flat base and the oil filter.

Accordingly, an object of the invention is to provide a positive means to secure an oil filter onto a support base.

Another object of the invention is to provide an economical means to support and secure a group of engine oil filters to a tray to make a shipping and display package.

Other objects and a fuller understanding of the invention may be had by referring to the following description and claims taken in conjunction with the accompanying drawing.

DESCRIPTION OF THE PREFERRED EMBODIMENT

Figure 1:
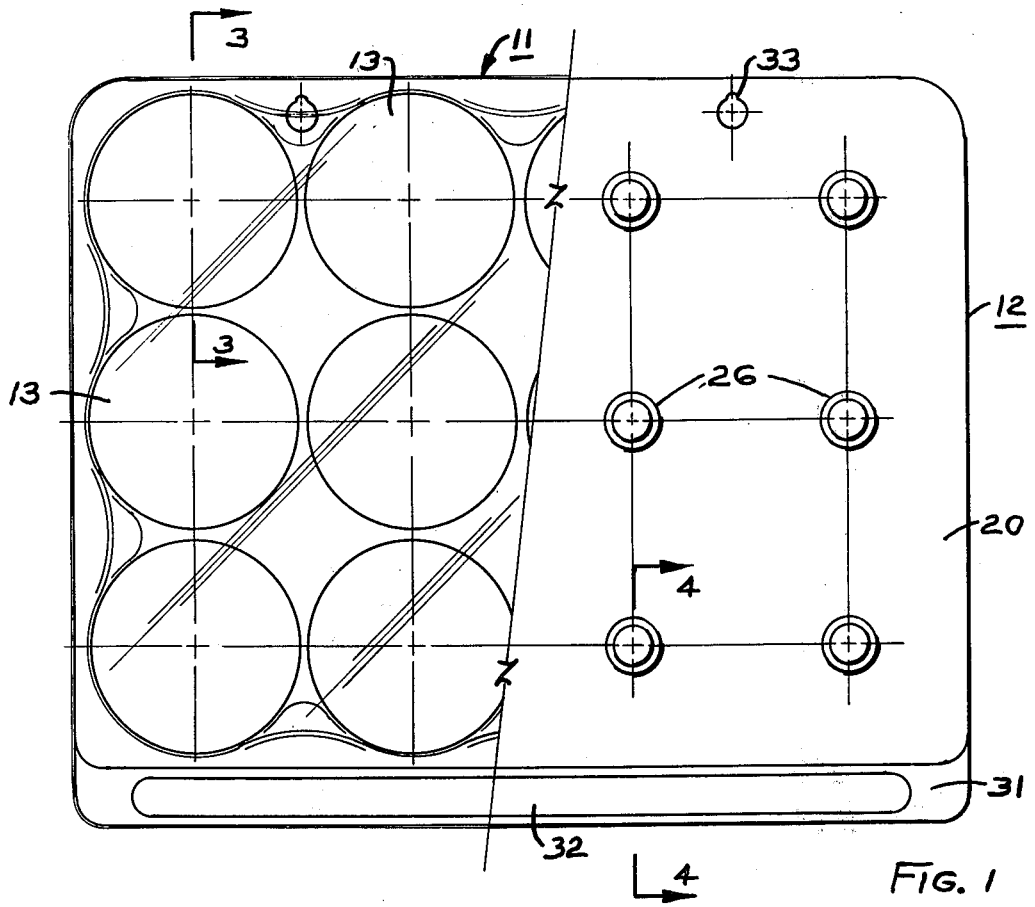
FIG. 1 is a plan view of a shipping and display tray on which a plurality of oil filters are secured, part of the oil filters being broken away to show the tray construction.
Figure 2:
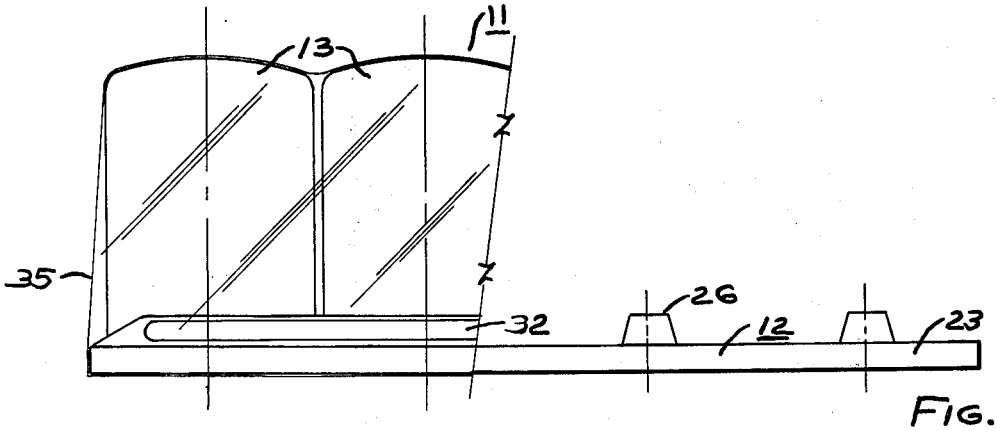
FIG. 2 is a front elevational view of the tray and package of FIG. 1, again with part of the oil filters being broken away.

The drawing illustrates a shipping and display package 11 which includes generally a tray 12 and a plurality of oil filters 13. The oil filters are internal combustion engine, such as automotive engine, oil filters of a shape generally of a right cylindrical wall 14 and an end wall 15 which is perpendicular to the axis of the cylinder. Each oil filter has female threads 16 in the end wall 15 which are adapted to be threaded on a male thread, not shown, of the internal combustion engine so that the oil of the engine is to be circulated within the oil filter for cleaning of the oil. An annular and usually circular gasket 17 is provided for the oil filter 13. This gasket is usually cemented or otherwise secured to the end wall 15, but occasionally it can become loose because of improper handling of the oil filter 13.

The tray 12 includes a generally flat base 20 having an upper surface 21 and a lower surface 22. A down-turned rim 23 stiffens this base and additionally stiffening ribs 24 may be provided in a square grid pattern. A plurality of male projections 26 are provided on the tray 12, and protrude upwardly from and are attached to the flat base 20. In the preferred embodiment these projections are knobs which have a frusto-conical outer surface 27 and a closed top 28 unitary with the base 20. The lower surface 22 of the flat base 20 is provided with recesses 29, complementary to the knobs 26 and in the preferred embodiment these recesses are frusto-conical recesses so that the wall thickness of the base 20 is substantially uniform.

A display lip 31 is provided. As shown this display lip preferably extends above the upper surface 21 of the base 20 and has a display panel 32 set at an angle for easy viewing. Such display panel may be recessed slightly and have molded therein indicia or other information or may receive a label bearing any desired information, including advertising.

The tray 12 is preferably a structure wherein the base is unitary with the projections 26, the rim 23 and the display lip 31. The tray may be made from many different materials such as plastic, impregnated paper, a stamping of thin gauge metal, or stampings of other materials. The tray is preferably provided with keyhole slots 33, two of which are shown in FIG. 1 so that the entire package 11 may be hung on a vertical wall, for example, for display. The tray has the advantages of having no returned surfaces and therefore a simple two-part mold may be used if the tray is a molded item and may also be formed by stamping in a two-part die, if a stamping is used for fabrication.

The complete package 11 is established by securing the oil filters 13 to the tray 12. The tray is designed to carry a plurality of such oil filters, and twelve oil filters are shown as an example. The means for securing the oil filters to the tray includes the knobs 26. The female threads 16 on the oil filters are a tapered pipe thread and hence the oil filters may simply be screwed into place on these knobs 26. In so doing the female threads of each oil filter will cut or otherwise laterally deform the outer conical surface of the knobs 26. The thin wall construction of each knob permits this lateral deformation. If a relatively hard plastic is used, for example, then a wall thickness perhaps thinner than that illustrated in the drawing will be used. If an impregnated paper is used for the material of the tray, then the wall thickness of each knob may be slightly greater than that illustrated. The choice of material will govern the thickness of the walls in the knobs so as to provide the requisite lateral deformation of these knobs as the oil filter is screwed onto this knob. The cutting or otherwise forming of the threads in each knob will establish a positive securing of each oil filter onto the tray 12. Thus this entire package 11 will be able to withstand the rough knocks and abuse of shipping and handling before final display to the retail customer.

This securing of each oil filter onto the tray 12 will also trap in place the annular gasket 17 between the end wall 15 of the filter and the upper surface 21 of the base 20. Thus even if the annular gasket should become dislodged from its cemented position on the oil filter wall, it is still trapped between the oil filter and the base 20, because it encircles the knob 26. This assures that the gasket will not become lost during shipping and handling and hence assures that the customer will receive an oil filter complete with gasket so that his oil filter which he purchases is completely operable.

Another part of the means to secure the oil filters to the tray 12 may be an enveloping wrap 35. This may take many different forms and a preferred form is a transparent shrink-wrap material which envelops the entire tray and oil filters. This protects them from being scuffed or marred, protects them from accidental dislodgement in case the entire tray is thrown around or otherwise abused, and keeps dirt off the oil filters so that they are more attractive and readily saleable. The entire wrapped package 11 may more easily be dusted off than to attempt to dust between the individual oil filters and hence the package is one which has a much longer shelf life. Also it is well known that in many cases during shipping and handling there is much abuse with many items merely being thrown into a truck or dropped a long distance and this enveloping wrap keeps the oil filters secure on the tray 12 despite such abusive handling.

Figure 3:
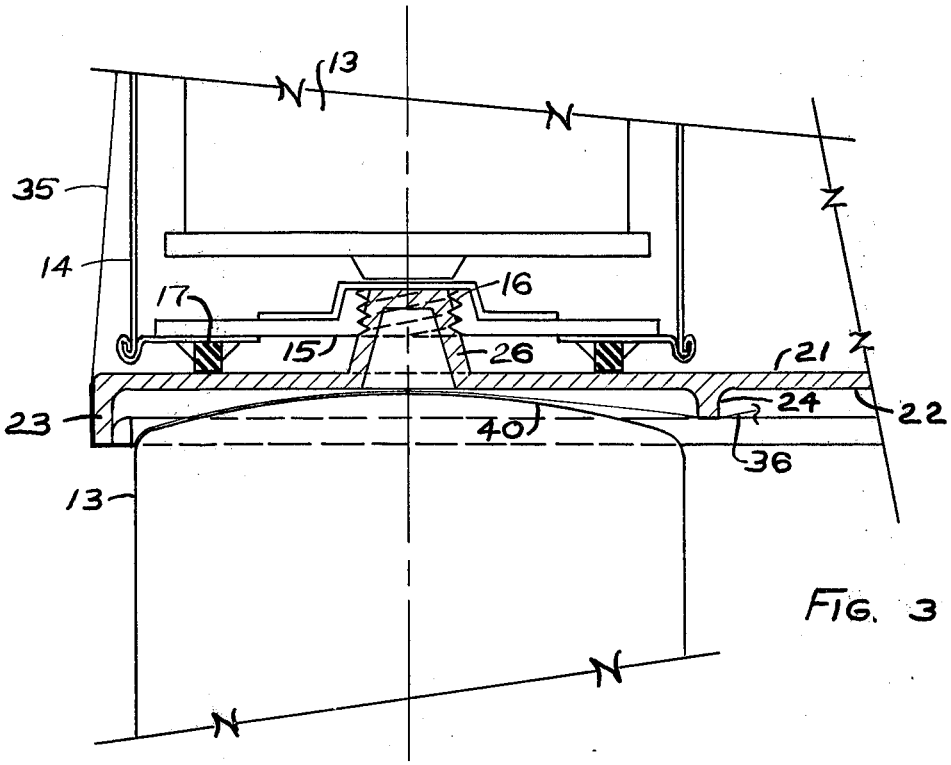
FIG. 3 is a sectional view on line 3—3 of FIG. 1.

The entire wrapped package 11 may be stacked on top of another wrapped package 11, as shown in FIG. 3. In this case the down-turned rim 23 is used to center and partially interlock one package with the one below. The shrink-wrap material will deform upwardly as at 36 by the weight of the upper package 11 being supported on an oil filter 13 of the wrapped package below. Accordingly, the packages 11 may be stacked to a considerable height without tipping over. The keyhole slots 33 permit the entire package 11 to be hung on a wall or other vertical support for display, primarily for retail selling purposes. In such vertical display the shrink wrap 35 may be present, with holes punched through it to have access to the keyhole slots 33, or the shrink wrap 35 may be removed so that each individual retail customer may unscrew and remove a desired oil filter 13. The entire package 11 may of course be laid flat on a shelf or other horizontal support for display for retail selling. In either case the display panel 32 readily identifies the material and provides advertising and specification details, as desired. The knobs 26 may vary in size as desired to accommodate a particular manufacturer's oil filter. They may be of different sizes on different trays or may be mixed with several sizes on one tray.

Figure 4:
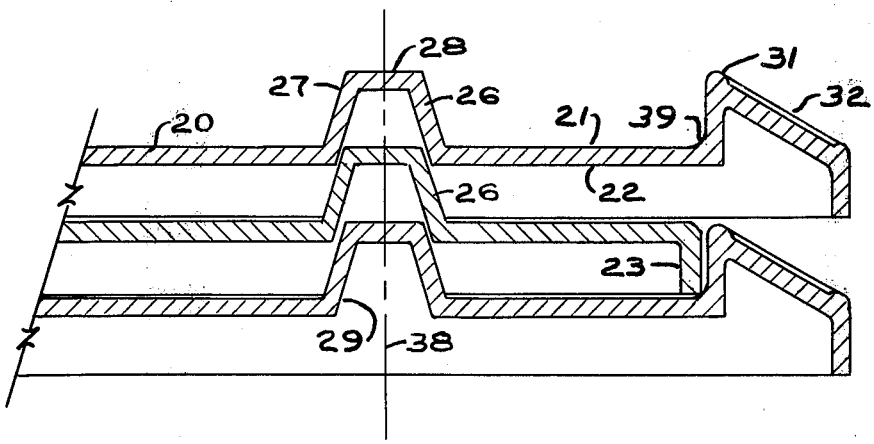
FIG. 4 is a sectional view on line 4—4 of FIG. 1 showing a stack of empty trays.

Another feature of the invention is the stackability of the empty trays, as shown in FIG. 4. This is a useful feature at the oil filter manufacturer's facility wherein the empty trays may be stacked awaiting being filled with the oil filters so as to produce the complete packages 11. As shown in FIG. 4, the display lip 31 extends above the level of the upper surface 21 to the level of the top 28 of the knobs 26. This permits a larger display panel 32 for better advertising and imparting of information to the retail customer. The trays may be stacked alternately 180 degress to accomplish this stacking, as shown in FIG. 4. This stacking is permitted because the distance from the centerline 38 of a knob 26 to the down-turned rim 23 of the tray is slightly less than the distance from the centerline of the knob to the upturned rim 39 which forms a part of the display lip 31. Accordingly, the down-turned rim 23 will fit within the display lip 31 for alternate stacking of the trays.

The frusto-conical recesses 29 perform two functions one of conically nesting with the knob above when empty trays are stacked, and also establishing a thin wall for the knob so that it may be deformed laterally, that is, parallel to the base 20. This lateral deformation permits the oil filters to be threaded onto each knob. The stiffening ribs 24 are preferably formed in a square grid pattern corresponding to the knobs 26 so that the upper surface 40 of an oil filter may upwardly deform the enveloping wrap 35 inside the square formed by the depending stiffening ribs 24. This also helps keep the loaded packages nested together when the packages are stacked in a tall column.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A shipping and display tray for use in connection with a plurality of internal combustion engine oil filters having female threads and annular gaskets comprising, in combination, a generally flat base, a plurality of male projections protruding upwardly from and attached to said base, said projections being of a semi-rigid material deformable in a direction parallel to said base, and said projections being engageable by female threads on an oil filter to trap the annular gasket of the oil filter between said flat base and the oil filter.

2. A tray as set forth in claim 1, wherein said projections are laterally deformably threadable by female threads on an oil filter.

3. A tray as set forth in claim 1, wherein said projections are unitary with said flat base and are formed of the same material.

4. A tray as set forth in claim 1, including keyhole slots in said flat base to aid in hanging the tray on a substantially vertical support for display.

5. A tray as set forth in claim 1, including a frusto-conical outer wall on each projection to engage the female threads on an oil filter.

6. A tray as set forth in claim 5, including a frusto-conical wall defining a recess in the underside of each of said projections with the recesses adapted to receive a corresponding projection of a second tray stacked beneath the first mentioned tray when said second tray is devoid of oil filters.

7. A tray as set forth in claim 1, wherein said projections are disposed on said flat base in a regular grid pattern with center-to-center distances being slightly greater than the diameter of the oil filters.

8. A shipping and display package for a plurality of engine oil filters comprising, in combination, a generally flat base, a plurality of engine oil filters of generally cylindrical form disposed on one side of said flat base, said filters having female threads and an annular gasket, securing means interconnecting said base and said filters and including a plurality of male projections protruding upwardly from and attached to said base, and said projections being of a semi-rigid material and engaged with said female threads on each oil filter to trap said annular gasket of said oil filter between said flat base and said oil filter.

9. A package as set forth in claim 8, wherein said projections are deformed laterally by engagement with said female threads on said filters.

10. A package as set forth in claim 9, wherein each of said projections is a frusto-conical knob fixed to said base, and a recess in the underside of each knob to aid in establishing each knob as being laterally deformable.

11. A package as set forth in claim 10, wherein said knobs initially have relatively smooth outer walls and are deformed laterally by threaded engagement with said female threads on said filters.

12. A package as set forth in claim 8, wherein said projections are fixed on said flat base.

13. A package as set forth in claim 8, wherein said projections are unitary with said flat base.

14. A package as set forth in claim 8, including apertures in said base adjacent one side thereof to aid in hanging the package in a substantially vertical position for display of said oil filters thereon.

15. A package as set forth in claim 8, wherein said securing means includes an enveloping wrap of sheet material enveloping all of said filters and at least part of the opposite side of said flat base.

16. A package as set forth in claim 15, wherein said enveloping wrap is a transparent shrink-wrap material to display said oil filters.

* * * * *